United States Patent [19]

Jones et al.

[11] 4,067,285

[45] Jan. 10, 1978

[54] MODULAR FLOATING STRUCTURE

[76] Inventors: Robert M. Jones, 532 E. Las Palmas, Fullerton, Calif. 92631; Don E. Johnson, 256 N. Fraser West, Mesa, Ariz. 85203

[21] Appl. No.: 676,756

[22] Filed: Apr. 14, 1976

Related U.S. Application Data

[63] Continuation-in-part of Ser. No. 564,419, April 2, 1975, Pat. No. 3,951,085, which is a continuation of Ser. No. 385,689, Aug. 6, 1973, abandoned.

[51] Int. Cl.[2] ..... B63B 35/44

[52] U.S. Cl. ..... 114/266; 114/267

[58] Field of Search ..... 114/.5 F, 43.5 R, 77 R, 114/267, 260, 266; 52/227, 228

[56] References Cited

U.S. PATENT DOCUMENTS

| | | | |
|---|---|---|---|
| 3,221,696 | 12/1965 | Gardner | 114/266 |
| 3,372,518 | 3/1968 | Rensch | 52/227 |
| 3,448,711 | 6/1969 | Mulholland et al. | 114/72 |
| 3,521,588 | 7/1970 | Atlas | 114/.5 F |
| 3,788,254 | 1/1974 | Sheil | 114/.5 F |
| 3,828,708 | 8/1974 | Gerwick, Jr. | 114/65 A |
| 3,983,830 | 10/1976 | Morgan | 114/77 R |

*Primary Examiner*—Trygve M. Blix
*Assistant Examiner*—Sherman D. Basinger
*Attorney, Agent, or Firm*—Gausewitz, Carr & Rothenberg

[57] ABSTRACT

This invention provides a floating structure made up of a plurality of individual modules, each of which has conduits extending through its walls. Tension members are threaded through the conduits and placed under tension to hold the modules together in a rigid assembly. Fasteners also may be used in securing the walls together, along with complementary aligning means to assure that the modules are held in a predetermined relationship.

7 Claims, 7 Drawing Figures

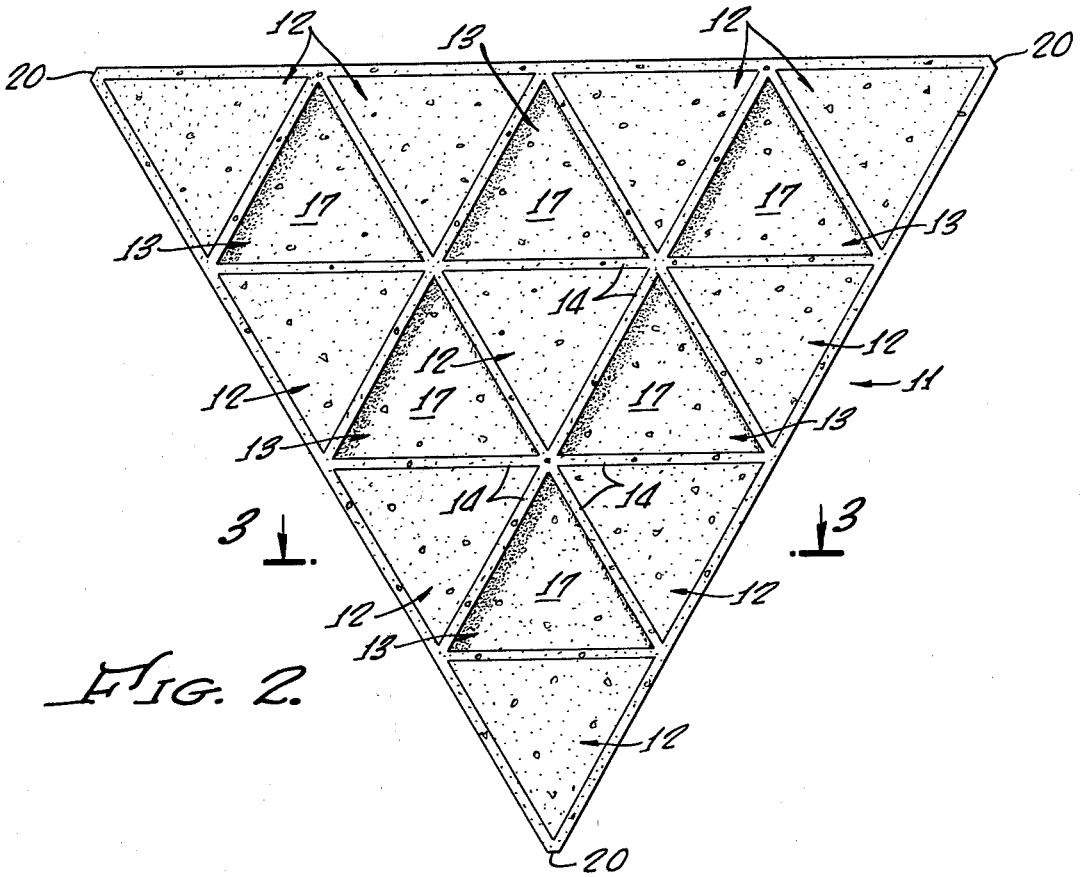
FIG. 2.
FIG. 3.
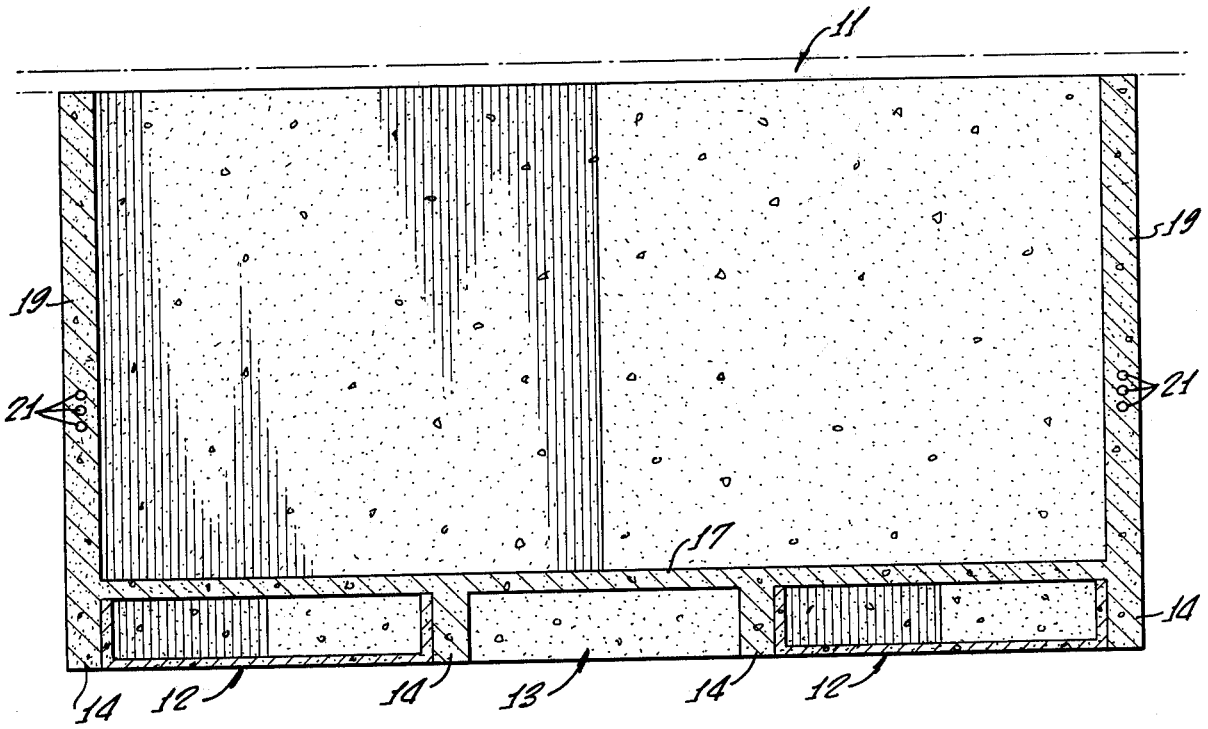

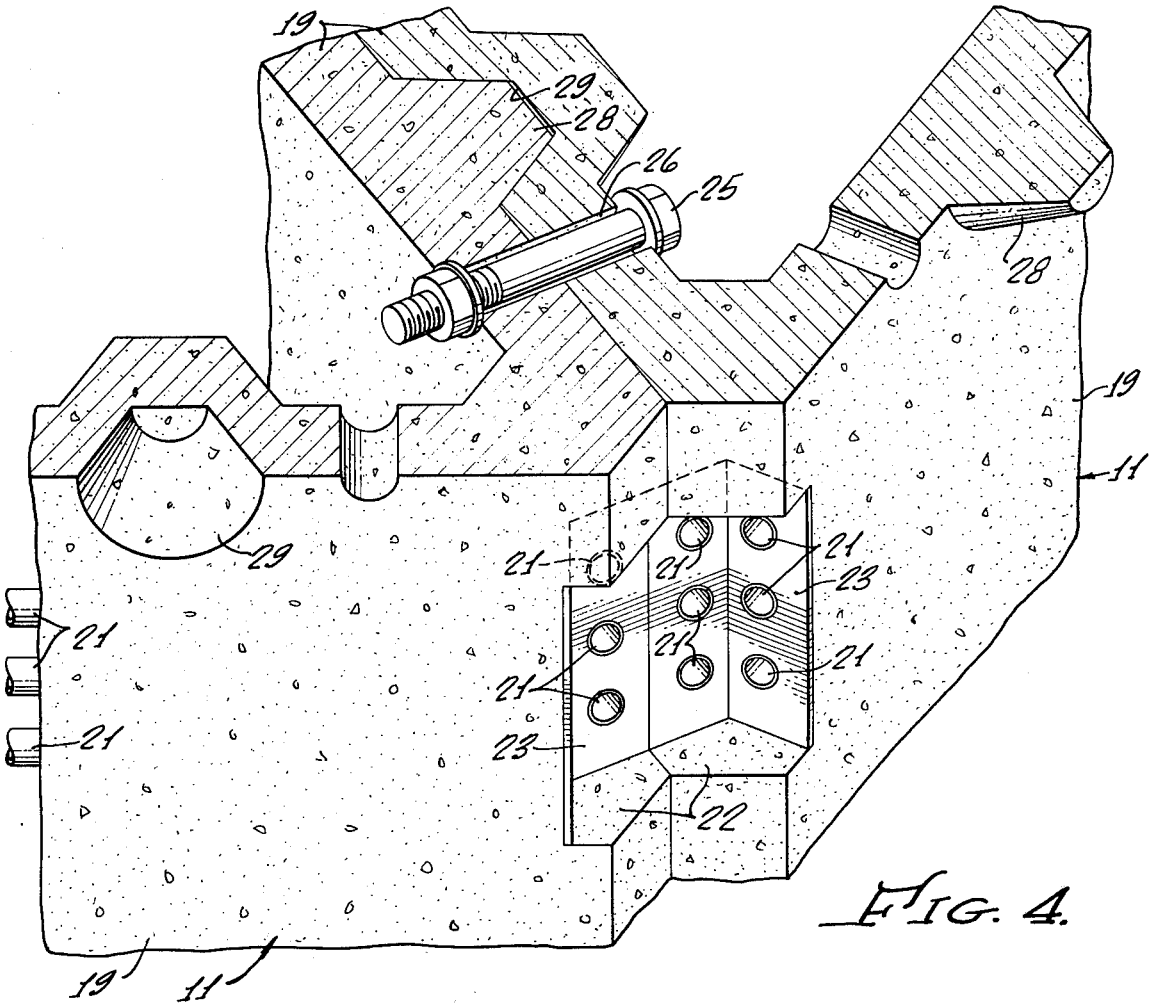
FIG. 4.
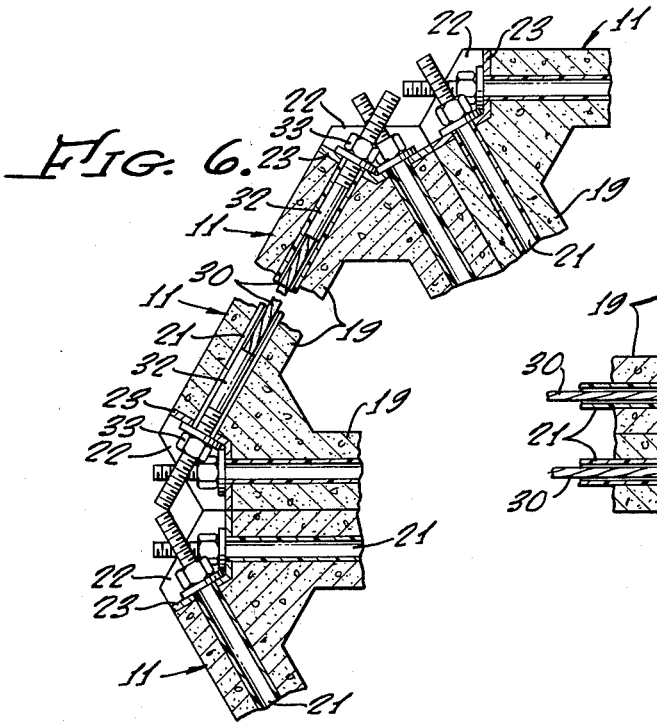
FIG. 6.
FIG. 5.
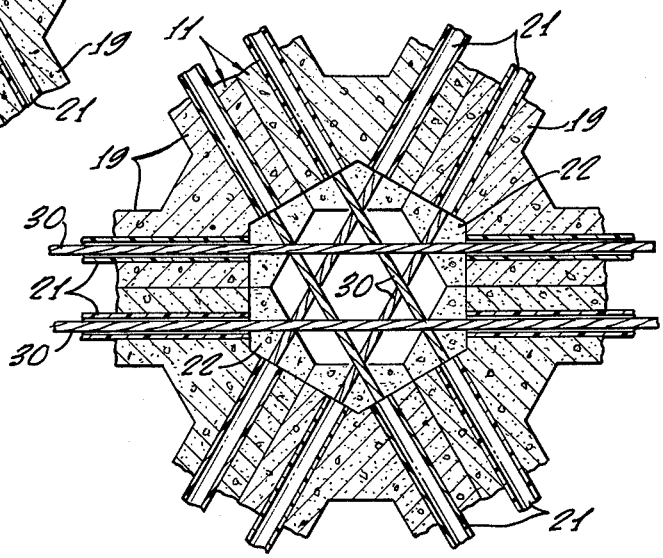

MODULAR FLOATING STRUCTURE

REFERENCE TO RELATED APPLICATIONS

This is a continuation-in-part of application Ser. No. 564,419, filed Apr. 2, 1975, and now U.S. Pat. No. 3,951,085 which is a continuation of our application Ser. No. 385,689, filed Aug. 6, 1973, now abandoned.

BACKGROUND OF THE INVENTION

1. Field of the Invention

This invention relates to a floating structure.

2. Description of the Prior Art

For many years man-made floating islands have been proposed because of the obvious need for such structures to serve a variety of purposes. Despite this, there has been little practical use of such man-made devices. This stems largely from the expense and difficulty in making floating islands, as well as from an inability to impart adequate strength and rigidity to the completed structure. The islands of prior designs have generally been heavy and lacked needed buoyancy. Also, they have not been capable of assembly into larger units securely held together as unitary structures.

SUMMARY OF THE INVENTION

The present invention provides an improved floating structure, readily assembled from easily manufactured modules. The floating structure is economically and rapidly made, yet has great strength and rigidity so that it will be able to withstand virtually any forces imposed upon it while in service. It is versatile in nature, allowing various numbers of modules to be assembled together in producing a floating island of desired size and shape.

In a typical example, the arrangement of this invention provides a floating island of hexagonal configuration made up of triangular modules. This is an especially efficient arrangement that lends itself to many purposes. However, islands of different shapes may be made and the modules that are assembled may have polygonal configurations other than triangular.

The modules that are assembled into the larger island structures may be themselves made up of individual modules which also may be triangular. All of the items advantageously are made of ferrocement which is quite suitable for floating structures. The modules that are used in constructing the islands have vertical walls around their perimeters which are provided with conduits through them that receive tension members such as cables or rods. When the modules are assembled, their walls are positioned in alignment and tension members extended through the conduits of the aligned walls from one side of the island structure to the other, as well as around its perimeter. The tension members are at different heights for their different directions so that they can overlap at the joints where the modules interconnect without interference with each other. After being extended through the walls, the tension members are tightened so as to securely draw the modules together and hold them rigidly in place.

Initially upon assembly, fasteners such as bolts are fitted through the module walls to attach the adjacent modules together. The modules incorporate an aligning means in the form of tapered protrusions and recesses which are brought into engagement as the modules are assembled. When the bolts are tightened, the tapered surfaces provide a self-centering effect which appropriately aligns the modules.

Upon completion of the assembly of the modules, cement is cast into the open spaces at the joints, and the island may be built upon and used in any desired way.

BRIEF DESCRIPTION OF THE DRAWINGS

FIG. 2 is a bottom plan view of one of the modules used in making up the floating structure shown in FIG. 1;

FIG. 3 is a sectional view, taken along line 3—3 of FIG. 2;

FIG. 4 is an enlarged fragmentary perspective view, partially broken away, showing the connections between adjacent modules;

FIG. 5 is a fragmentary top plan view of one of the joint areas of the floating structure;

FIG. 6 is a fragmentary sectional view showing the tension members within the conduits through the walls of the modules.

DESCRIPTION OF THE PREFERRED EMBODIMENT

Figure 1:
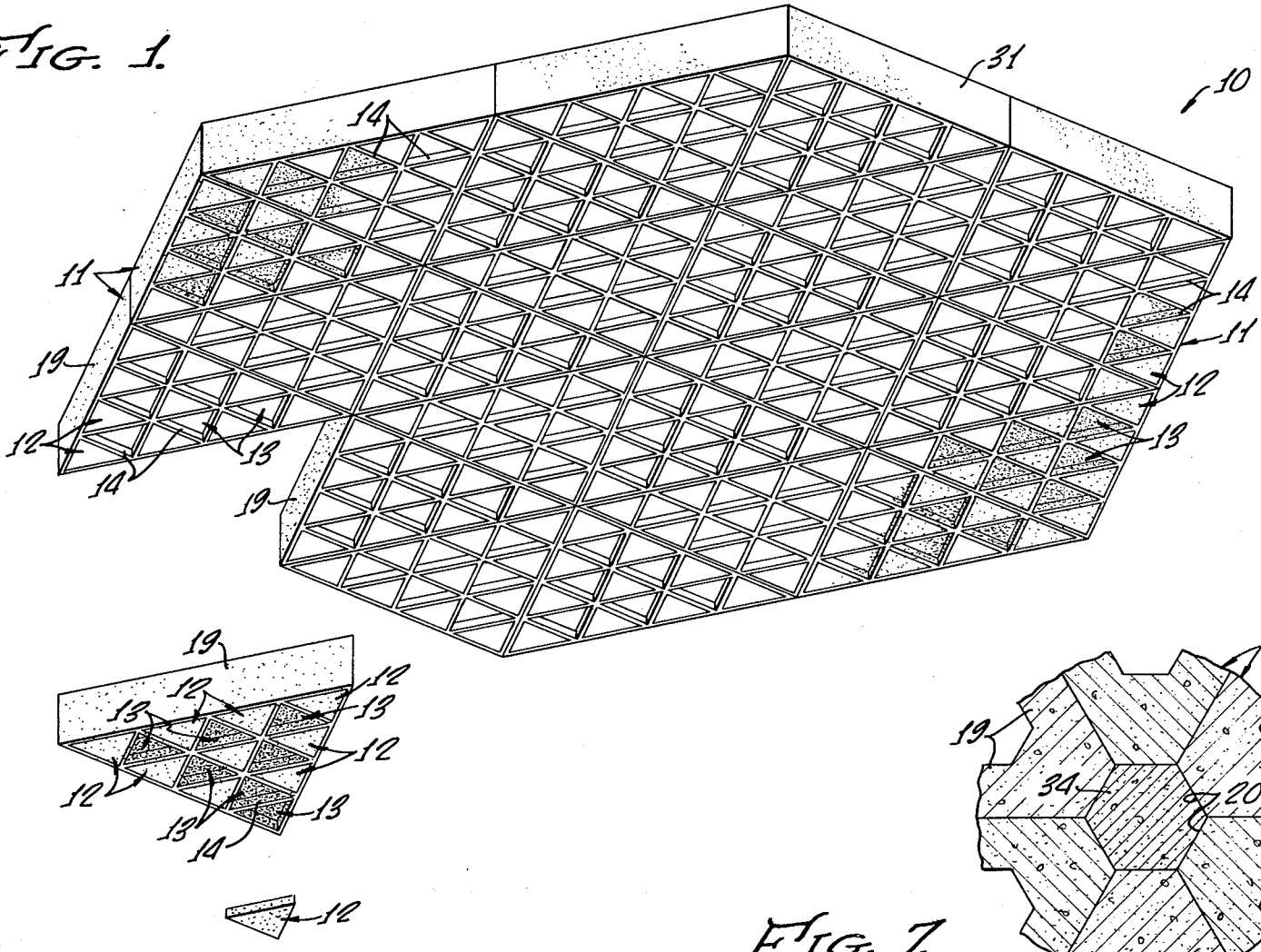
FIG. 1 is a perspective view of a floating structure made in accordance with this invention, as seen from below.

The floating island 10, shown from the bottom side in FIG. 1, is of hexagonal shape made up of a plurality of triangular modules 11 of identical overall dimensions. These, in turn, are composed of smaller triangular modules 12. The modules 11 and 12 may be constructed in accordance with the aforementioned application Ser. No. 564,419. In a typical example, the individual modules 12 are shaped as equilateral triangles in plan view, each side being 16 feet long made of reinforced ferrocement. In forming the larger modules 11, which are equilateral triangles having 65-foot sides, the modules 12 are arranged in rows, but need not fill all of the spaces in the module 11. That is to say, the modules 12 alternate in the rows, leaving spaces 13 between adjacent modules. Thus, in a module 11, when viewed as positioned in FIG. 2, with one of the sides horizontal, there are four of the modules 12 in the top row, three in the second row, two in the next, and one at the bottom apex of the triangle. Hence, there are three spaces 13 in the top row, two spaces 13 in the next row, and one space 13 between the two modules 12 in the row next to the bottom.

The modules 11 also may be made with a greater number of modules 12, omitting the spaces 13. Walls are cast around the modules 12 in making up the larger modules 11. These walls, like the construction of the modules 12, are made up of ferrocement. Included are relatively short vertical walls 14 which extend around the sides 15 of each of the modules 12 and are of the same vertical height as the sides 15 of the modules 12. The casting may be continuous so that the walls 14 provide a unitary structure. Additionally, a floor 17 of the ferrocement is cast in place over the tops of all of the modules 12, as well as over the spaces 13 intermediate the modules 12, forming a continuous surface over the entire lateral dimension of the module 11.

Around the outside of the module 11, extending above the floor 17, are vertical side walls 19, again, cast of ferrocement. At the periphery of the module 11, the walls 19 form continuations of the shorter vertical walls 14. In an example where the walls are 1 foot six inches in height, the vertical walls 19, above them at the perimeter of the modules 11, are eleven feet 6 inches in height. The apexes of the modules 11 are flattened at the ends of the walls 19 and peripheral walls 14, providing narrow flat vertical surfaces 20.

With the addition of the walls 19, the module 11 has buoyancy. It is adapted for construction on a barge, which is sunk upon completion of the module to leave the module floating for subsequent assembly into the island 10. A cofferdam may be used in lieu of the barge to allow construction of the module 11 and its later flotation.

Buried within the walls 19, by being positioned appropriately prior to the casting of these walls, are conduits 21. These elements, which may be of smooth plastic such as polyvinyl chloride, extend horizontally the full lengths of the walls 19. Thus, they provide small passageways extending entirely through the walls 19. The conduits 21 are relatively nearer the bottom of the walls 19 than the top, positioned close to one-third of the way up the walls 19. In each wall 19 there are three of the conduits 21, positioned one above the other and relatively closely spaced. At the locations of the conduits 21, the ends 20 of the walls 19 are provided with recesses 22 within which are vertical steel plates 23 overlying the vertical surfaces of the recesses 22. The steel plates 23 are perpendicular to the axes of the conduits 21 and provide bearing surfaces used in the securing of the modules 11 together in forming the floating island 10.

When the modules 11 are assembled, their initial attachment is by bolts 25 that extend through openings 26 in the walls 19. Tightening of the bolts 25 causes the outer surfaces of the walls 19 of the attached modules to lie against each other. As the modules 11 are grouped together in making up the hexagonal floating island 10, connecting points are formed within the island 10 where the apexes of six modules meet. Around the periphery of the island 10, there are connecting points at the intersections of the apexes of three adjoining modules. At the outside corners the apexes of two modules 11 come together. The walls 19 of various modules form rows around the periphery of the island 10 as well as through it.

The modules are aligned as the attachment is made by the bolts 25. This alignment is accomplished by protrusions 28 and recesses 29, integral with the walls 19 of the modules 11. The protrusions 28 and recesses 29 are of frustoconical configuration complementary to each other. There may be a protrusion 28 or recess 29 at either end of the walls 19 of each of the modules 11. When the modules are secured together the protrusions 28 enter the recesses 29. This provides alignment of the modules as the tapered surfaces of the protrusions and the recesses guide the modules and produce accurate relative positioning. As a result, there is registry between overlapping walls 19 and the rows of walls 19 are planar. The conduits 21 in the rows are in end-to-end alignment.

After the modules have been secured together by the bolts 25 and are aligned through the protrusions 28 and recesses 29, their attachments are completed by tension members 30 which are received in the conduits 21. The smooth surfaces of the conduits 21 facilitate the threading of the tension members through the conduits. The tension members 30, which may be cables or rods, extend through all of the walls 19 of the assembled modules of the floating structure 10. Thus, the tension members 30 are of different lengths, depending upon their locations, and extend all the way through the floating structure 10, as well as around its periphery. The ends of the tension members 30 are at the outer sides 31 of the hexagonal island 10. The tension members 30 extend through the aligned rows of walls 19, going from one module to the next in the structure 10. Consequently, at each joint where the modules come together there will be several tension members 30 crossing each other. It is for this reason that there are three conduits 21 in each of the walls 19, which allows the tension members 30 to be located at three different levels. In each wall 19, therefore, only one conduit 21 will be utilized in the completed structure. It is preferred to provide three conduits, however, in order to permit interchangeability of the modules. In other words, irrespective of how a particular module is positioned, the appropriate conduit 21 will be aligned with the conduit 21 of the adjacent modules, allowing free passage of the tension members 30 from one module to the next.

In the structure 10 all of the tension members 30 going in one direction are at the same level. This may be seen in FIG. 5, where a joint within the structure 10 is illustrated, interconnecting the apexes of six modules 11. The two tension members 30 that extend horizontally in this illustration are in the top conduits 21 of the walls 19. The tension members 30 inclining upwardly from the lower right to the upper left in this view are in the center conduits 21 of the walls 19. The remaining tension members 30, which extend from the lower left to the upper right, as shown in FIG. 5, are in the bottom row of conduits 21 of the walls 19. The same holds true for all the joints throughout the structure 10. Thus, by having the tension members 30 on three levels, it is possible to interconnect six modules at a joint without interference from the overlapping cables.

After the tension members 30 have been extended through the conduits 21, they are placed under tension, which securely holds the modules 11 together in forming the unitary structure 10. This may be accomplished by use of exteriorly threaded cylindrical ends 32, swaged on the cables forming the tension members 30 shown and engaged by the nuts 33. By tightening the nuts 33 against the bearing plates 23, the cables 30 may be placed under tension. When this is done, the tension force in the cables 30 is transmitted to the modules 11 at the outer sides of the island 10, and the modules are tightly drawn together. This simple arrangement assures that the structure 10 is unitary, and that the individual modules making it up are securely held and will not shift or move relative to each other.

Figure 7:
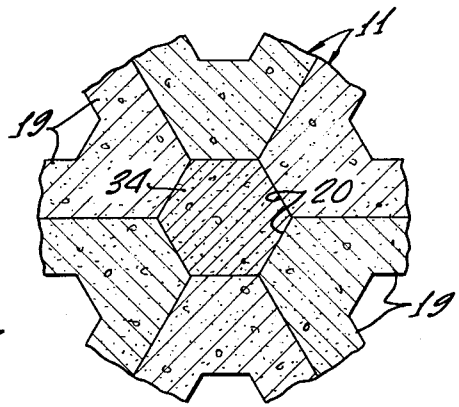
FIG. 7 is a fragmentary plan view of a completed joint within the floating structure.

When the joints are complete, additional cement 34 is cast into the open space of the joint, as shown in FIG. 7. This preferably is an expansible cement of the magnesium carbonate family, which adds to the tension in the cables 30.

The foregoing detailed description is to be clearly understood as given by way of illustration and example only, the spirit and scope of this invention being limited solely by the appended claims.

We claim:

1. A buoyant structure comprising a plurality of polygonal modules grouped in adjacency, each of said modules including a plurality of upstanding walls, said walls of said modules being positioned in a plurality of aligned rows extending in different directions, said rows intersecting at the ends of said walls, means defining openings through said walls such that said openings in each of said rows are in substantial axial alignment, and elongated tension members in said openings and extending the lengths of said rows for bearing upon said walls at the ends of said rows and holding said modules together, said elongated tension members where said rows so intersect being at different levels so that said tension members do not interfere with each other.

2. A device as recited in claim 1 in which there are a plurality of said rows of said walls extending in parallelism in one direction, and a plurality of said rows of said walls extending in parallelism in a different direction, said tension members in said rows of said walls in said one direction being at a first level, said tension members in said rows of said walls in said different direction being at a second level.

3. A device as recited in claim 1 in which at least some of said modules consist of a plurality of smaller modules, and said smaller modules are within said upstanding walls.

4. A device as recited in claim 3 in which said upstanding walls are higher than said smaller modules, whereby said upstanding walls extend above said smaller modules.

5. A device as recited in claim 4 in which the lower ends of said upstanding walls are substantially at the level of the lower ends of said smaller modules.

6. A buoyant structure comprising at least two relatively large modules having portions in adjacency, each of said relatively large modules being made up of a plurality of smaller modules, and means interconnecting said relatively large modules, said interconnecting means including means defining openings through said relatively large modules substantially in axial alignment, and an elongated member extending through said openings, said elongated member being under tension for holding said relatively large modules in adjacency each of said relatively large modules including substantially vertical walls extending around said plurality of smaller modules, said substantially vertical walls being higher than the height of said smaller modules, said means defining said openings being located within said substantially vertical walls above said plurality of smaller modules.

7. A device as recited in claim 6 including a substantially horizontal floor superimposed on said plurality of smaller modules beneath said means defining said openings, said floor interconnecting said substantially vertical walls of said relatively large modules.

* * * * *